US006997801B1

(12) United States Patent
Green

(10) Patent No.: US 6,997,801 B1
(45) Date of Patent: Feb. 14, 2006

(54) ROOFING VENT WITH SLIDING COLLAR

(76) Inventor: Robert Dallas Green, 6523 Big Horn Trail, Littleton, CO (US) 80125

( * ) Notice: Subject to any disclaimer, the term of this patent is extended or adjusted under 35 U.S.C. 154(b) by 167 days.

(21) Appl. No.: 10/652,124

(22) Filed: Aug. 29, 2003

(51) Int. Cl.
*F24F 11/02* (2006.01)

(52) U.S. Cl. ..... 454/368; 285/43

(58) Field of Classification Search ..... 285/42, 285/43, 44; 454/367, 368
See application file for complete search history.

(56) References Cited

U.S. PATENT DOCUMENTS

| | | | | | |
|---|---|---|---|---|---|
| 1,587,250 | A | * | 6/1926 | Stephenson | 285/44 |
| 2,183,645 | A | * | 12/1939 | Hansen | 454/363 |
| 3,125,357 | A | * | 3/1964 | Kifer | 285/44 |
| 4,803,816 | A | | 2/1989 | Klober | |
| 4,897,974 | A | * | 2/1990 | Lane | 52/199 |
| 5,005,328 | A | | 4/1991 | Holtgreve | |
| 5,080,007 | A | * | 1/1992 | Maheu | 454/254 |
| 5,213,542 | A | * | 5/1993 | Kelly | 454/357 |
| 5,234,582 | A | | 8/1993 | Savoie | |
| 5,328,212 | A | | 7/1994 | Kosik, Jr. et al. | |
| 5,456,433 | A | * | 10/1995 | Burns et al. | 248/148 |
| 5,472,241 | A | | 12/1995 | Kosik, Jr. et al. | |
| 5,536,048 | A | | 7/1996 | Orr | |
| 5,561,952 | A | | 10/1996 | Damron | |
| 5,860,256 | A | | 1/1999 | Humber | |
| 6,256,947 | B1 | * | 7/2001 | Grubb | 52/200 |

FOREIGN PATENT DOCUMENTS

| | | |
|---|---|---|
| EP | 0 284 758 A1 | 5/1988 |

* cited by examiner

*Primary Examiner*—Harold Joyce
(74) *Attorney, Agent, or Firm*—Ramon L. Pizarro; Edwin H. Crabtree

(57) ABSTRACT

A roofing vent that includes a base a duct extending from the base. The duct includes a first end attached to the base and a second end having a hood or cover over the second end. A collar having an aperture therethrough is mounted from the duct such that the duct extends through the aperture, with the collar is slideably supported along the duct and captured between the base and the hood or cover.

4 Claims, 2 Drawing Sheets

ROOFING VENT WITH SLIDING COLLAR

BACKGROUND OF THE INVENTION (a) Field of the Invention

This invention generally relates to a system and method for installing and sealing roofing vents. And more particularly, but not by way of limitation, to an air vent for roofing that includes a sliding collar that is adapted to slide down against roofing tiles or shingles and seal around the aperture in the roofing shingles or tiles.

(b) Discussion of Known Art

Modern framed building construction uses wood or metal framed roofs that support layers of roofing material, such as plywood and tar-paper, which is then covered with shingles or tiles. In order to provide appropriate ventilation for the building, ducts that extend from interior portions of the building have to extend through the roofing material and tiles, so that the ducts can vent into the atmosphere. Additionally, roofing vents allow attic air to escape without the aid of additional ducting.

A significant problem associated with extending ducts through roofs is that the aperture through which the duct extends must be sealed to prevent the entry of moisture or other elements, which can deteriorate the underlying roofing materials and damage the structure.

An important problem associated with sealing or isolating the aperture through which the duct extends is that it is time consuming, involving an undesired number of steps that must be carried out by the roofing crew. The larger the number of steps required, the greater the possibility of human error and possibility for leakage. Still further, the greater the number of steps required to install the duct sealing mechanisms, the greater the expense associated with the construction process.

The problem of sealing the roof area becomes particularly acute with roofing vents that require the use of a hood or cap that covers the end of the duct to prevent the entry of rain, snow or other foreign materials. This is because the hood or cap must be of a diameter or cross-section that is larger than the cross-section of the duct extending through the roof.

Thus, there remains a need for a roofing duct or ventilation device that can be easily installed on a roof, without harming or corrupting other components of the roofing system. For example, the duct or ventilation device must be able to cooperate with the roofing felt or waterproofing material as well as a variety of shingle types.

Still further, there remains a need for a device or system that allows the placement of a roofing duct or ventilation device without the need to disassemble and then assemble the roofing duct or device.

SUMMARY

It has been discovered that the problems left unanswered by known art can be solved by providing a roofing vent that includes:

a base;

a duct extending from the base, the duct being of a cross-sectional area and having a first end attached to the base and a second end, the second end having a hood or cover over the second end; and a collar, the collar having an aperture therethrough, the duct extending through the aperture, so that the collar is slideably supported along the duct and captured between the base and the hood or cover.

It is contemplated that the cross-section of the duct may be of any desired geometric shape, with the collar having an opening that will match this geometric shape or cross-sectional profile. On installation, the collar is simply moved along the duct until it is next to the tiles or shingles. The collar is then sealed against the upper surface of the tiles or shingles with an appropriate sealing agent, such as a mastic sealant.

It is also contemplated that the base will be made from a generally flexible sheet of material, such as sheet metal, and in one example of the invention the collar will parallel the shape of the base.

It will be understood that the disclosed invention will simplify the mounting and sealing of ventilation ducts on roofs. It is contemplated that the base will be attached to the roof prior to installation of the roofing tile. Then the roofing tile will be mounted over the roof and the base. The collar will then be moved or forced down against the roofing tile.

Sealing around the collar to prevent entry of water and debris under the collar is carried out as normally done in the trade.

It will be understood that the disclosed system avoids the need to have the installer carry and install separate collars as described in U.S. Pat. No. 5,536,048, which illustrates a plumbing vent that does not require a cap or hood. However, most roofing ventilation ducts require the use of a cap or over the end of the vent duct. The installation of this hood or cap over the end of the duct requires additional labor that must be carried out in the field, on top of the roof structure. Additionally, the installation of the cap provides further opportunity for defects in the construction process.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
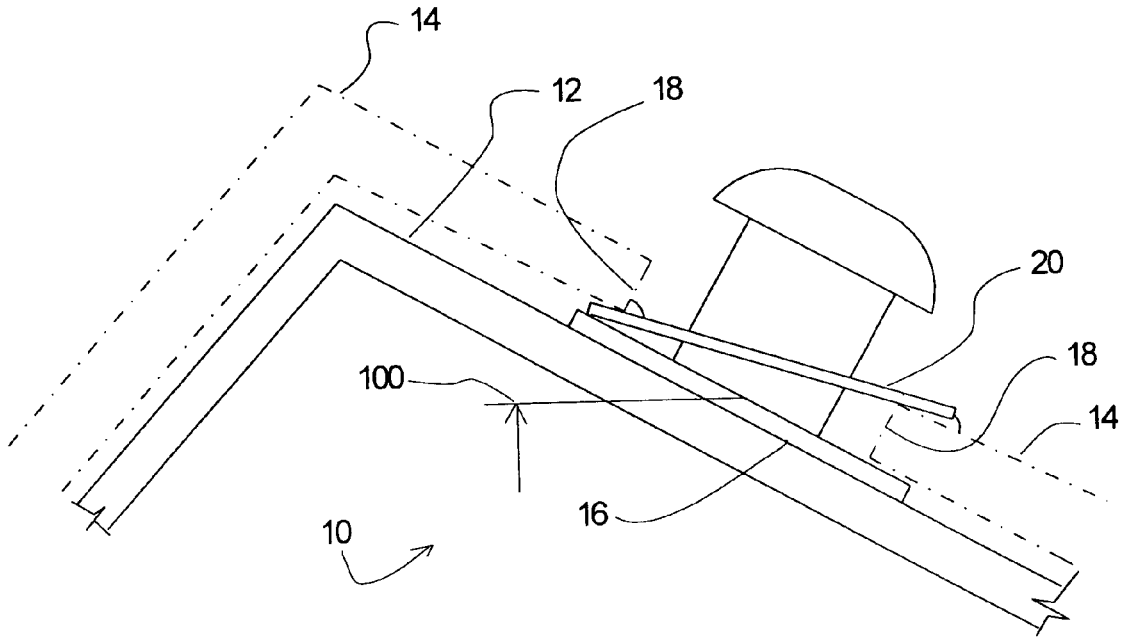
FIG. 1 illustrates an example of an installed vent including an example of the disclosed invention.

Turning now to FIG. 1 where a roofing vent 10 has been illustrated mounted on a roof 12 that is to be covered with roofing shingles or tiles 14. The roof 12 may be of wood or any other material used in construction. The roofing vent 10 includes a base 16 that is fastened to the roof by nails, screws, or other fasteners.

As the roof is covered with shingles or tiles 14, an aperture 18 must be made in through the shingles or tiles 14. The aperture is made by omitting shingles from the roof and by breaking some of the shingles or tiles being installed. The shingles or tiles 14 are placed over the base 16 such that the aperture 18 is positioned over or about the base 16. Then, the collar 20 of the roofing vent 10 is slid down along the duct 22 and coerced under the shingles or tiles 14 at areas where the shingles or tiles 14 are an elevation that is higher than the elevation 100 of the duct 22, and over the shingles or tiles 14 at locations where the shingles or tiles are lower than the elevation 100 of the duct 22. In order to prevent the seepage of water or other foreign matter under the collar 20, the collar 20 is sealed against the shingles or tiles 14 with the use of a suitable mastic sealant, or other sealant. Thus, it should be understood that it is contemplated that the collar 20 will be made of a flexible material, such as sheet metal, that will allow coercion by flexing and manipulation of the collar under shingles or tiles that lie generally higher than the duct 22, while placing the collar over a succeeding row of shingles or tiles that are generally lower than the duct 22.

It is important to note that it is contemplated that the base 16 should be generally flat, and that the collar 20 may be flat or corrugated, or include features that would enhance the sealing of the collar 20 against the shingles or tiles 14. Thus, it is contemplated that the collar 20 may incorporate a border that follows the contours of Spanish tile, for example. Additionally, the collar 20 may incorporate features that would prevent the accumulation of water between the tiles and the roofing vent 10. Still further, it is contemplated the collar may include a surface area that is larger or smaller than the base 16.

Figure 2:
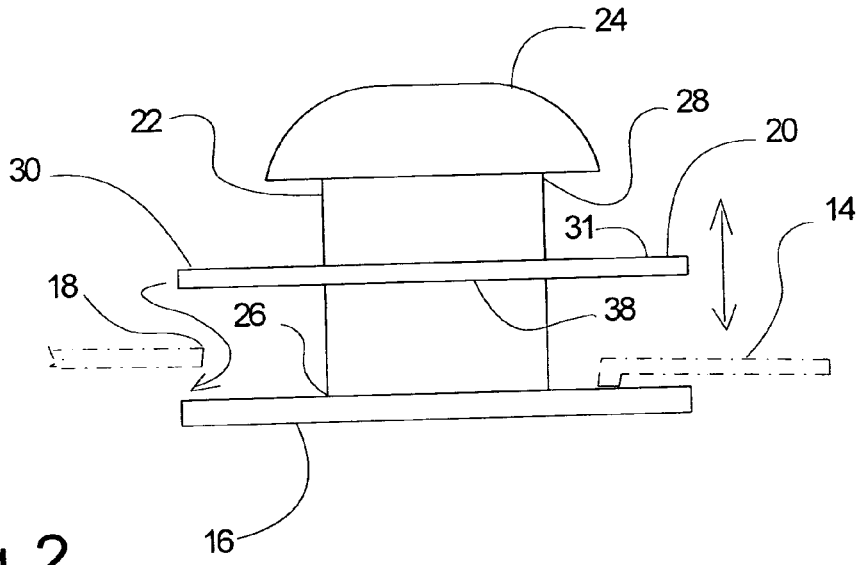
FIG. 2 is a side view of an example of the disclosed invention.

As illustrated in FIG. 2, it is contemplated that the roofing vent 10 will include a hood 24 that cover the opening of the duct 22 to prevent entry of water or other debris into the duct 22. It is contemplated that the roofing vent 10 will be assembled at the factory where the base 16 is fixedly attached to the first end 26 of the duct 22. The hood 24 is fixedly attached to a second end 28 of the duct 22, trapping the collar 20 along the duct 22, between the base 16 and the hood 24. Once the base 16 is attached to the roof 12, a portion 30 of the collar 20 will be coerced under the shingles or tiles 14, while another portion 31 of the collar 20 will be positioned over the shingles or tiles 14.

Figure 3:
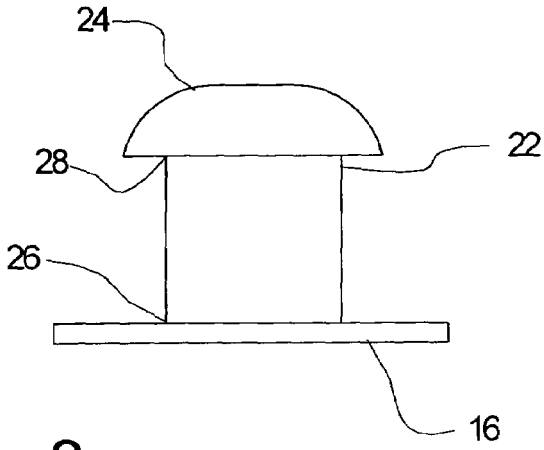
FIG. 3 illustrates the duct, base and hood of a vent that incorporates the disclosed invention.
Figure 5:
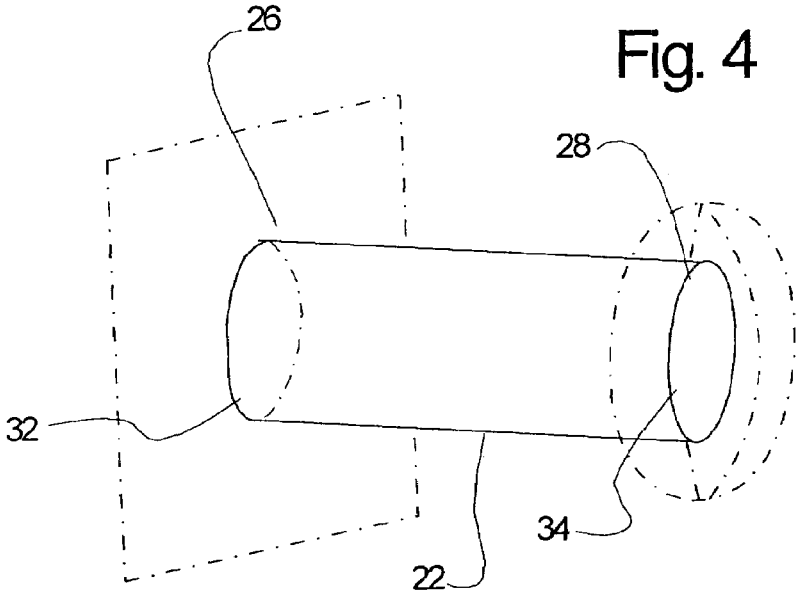
FIG. 5 is a top, end view of a tapered sleeve that maybe used with the disclosed invention.

FIGS. 3 and 5 illustrate an example of the components used in making the roofing vent 10. In this example the duct 22 the first end 26 of the duct 22 will be of a first cross-sectional area 32 and attached to the base 16. The hood 24 will cover the second end 28 and prevent the entry of water or other foreign matter. It is contemplated that the hood 24 will be permanently attached to the second end 28 after the collar 20 is installed along the duct 22. However, while it is preferred that the hood 24 be permanently attached, the hood 24 may be removable, allowing the matching or changing of the collar 20 in the field.

Figure 4:
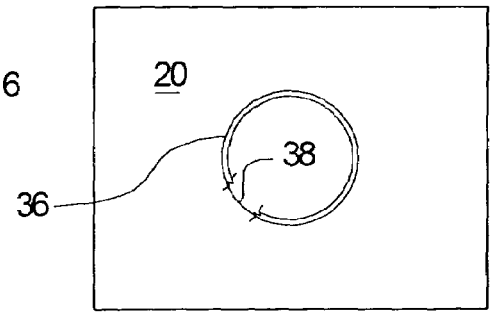
FIG. 4 is an end view of an example of the collar used with the disclosed invention.

FIG. 4 illustrates that it is contemplated that a sleeve 36 may be mounted about the aperture 18. The sleeve 36 mounts with the collar 20 over the duct 22, providing greater sealing surface area between the collar 20 and the duct 22.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A method for installing roofing vent on a roof to be finished with tile or shingles, the method comprising:

providing a pre-assembled roofing vent having:

a base;

a duct extending from the base, the duct being of a cross-sectional area and having a first end fixedly attached to the base and a second end, the second end having a hood or cover fixedly attached to the second end; and a sliding collar, the collar having a base and an aperture therethrough, the duct extending through the aperture such that the sliding collar encircles the duct, the aperture being of a size that does not permit the base or the hood or cover to pass through the aperture, so that the collar is slideably supported along the duct and captured between the base and the hood or cover prior to installation of the roofing vent on the roof;

attaching the base to the roof with the duct at an elevation;

sliding a portion of the collar along the duct towards the hood or cover, so that a portion of the collar is in contact with the base and a portion of the collar is separated from the base;

placing a set of tiles around the base and over the portion of the collar that is in contact with the base; and placing some of the tiles under the collar and over the base under the portion of the collar that is separated from the base.

2. A method according to claim 1 and further comprising placing the collar over tiles that are at a lower elevation than the duct and placing the collar below the tiles that are at a higher elevation than the duct.

3. A method according to claim 2 wherein said collar includes a sleeve that is movable in a generally parallel direction relative to the duct, the sleeve being mounted around the aperture in the sleeve.

4. A method according to claim 1 wherein said collar further comprises a sleeve that is generally parallel and spaced from the duct.

* * * * *